US009853352B1

(12) United States Patent
Chen et al.

(10) Patent No.: US 9,853,352 B1
(45) Date of Patent: Dec. 26, 2017

(54) ANTENNA MODULE, SIGNAL ENHANCEMENT DEVICE AND COMMUNICATION DEVICE

(71) Applicant: Cheng Uei Precision Industry Co., Ltd., New Taipei (TW)

(72) Inventors: Guan Yi Chen, New Taipei (TW); Wen Bing Hsu, New Taipei (TW); Kuo Wei Chang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 30 days.

(21) Appl. No.: 15/232,643

(22) Filed: Aug. 9, 2016

(51) Int. Cl.
*H01Q 1/24* (2006.01)
*H01Q 9/42* (2006.01)

(52) U.S. Cl.
CPC ..... *H01Q 1/243* (2013.01); *H01Q 1/241* (2013.01); *H01Q 1/242* (2013.01); *H01Q 1/245* (2013.01)

(58) Field of Classification Search
CPC ..... H01Q 1/24; H01Q 1/241; H01Q 1/242; H01Q 1/243; H01Q 9/42
See application file for complete search history.

(56) References Cited

U.S. PATENT DOCUMENTS

2008/0316120 A1* 12/2008 Hirota ..... H01Q 1/2258 343/702
2010/0271256 A1* 10/2010 Tsunekawa ..... B60R 21/0134 342/70
2014/0340265 A1* 11/2014 Vazquez ..... H01Q 9/42 343/702
2015/0002341 A1* 1/2015 Cho ..... H01Q 1/243 343/702

* cited by examiner

*Primary Examiner* — Hoang Nguyen
(74) *Attorney, Agent, or Firm* — WPAT, P.C., Intellectual Property Attorneys; Anthony King

(57) ABSTRACT

A signal enhancement device includes a back cover and an antenna module. The back cover includes a backboard for covering a rear surface of a main body and a top board for covering a top of the main body. The antenna module includes a base portion of board shape for being fixed on a portion of an inside surface of the backboard adjacent to the top board, a first bending portion for being fixed on an inside surface of the top board, a second bending portion for being fixed on a front end surface of the top board, and a third bending portion for being fixed on an outside surface of the top board and a portion of an outside surface of the backboard adjacent to the top board. When the signal enhancement device is mounted on the main body, the antenna module is capable of coupling with a communication antenna of the main body so as to enhance signal quality of the communication antenna.

17 Claims, 2 Drawing Sheets

ANTENNA MODULE, SIGNAL ENHANCEMENT DEVICE AND COMMUNICATION DEVICE

BACKGROUND OF THE INVENTION

1. Field of the Invention

The present invention relates to a signal enhancement device with an antenna module as a part of a communication device for enhancing signal quality of the communication device.

2. The Related Art

At present, communication devices such as mobile phone include a communication antenna, a battery, a radio frequency module, and other kinds of electronic components. The communication antenna is easily affected by electromagnetic coupling effects of adjacent electronic components to make the efficiency of the communication antenna reduced. Designers reserve an isolation distance between the communication antenna and the adjacent electronic components in order to solve the problem of the electromagnetic coupling effects. Nevertheless, the above design method increases inner space of the mobile phone.

In order to solve the above problems, some designers embed the communication antenna in a framework of the mobile phone or the other communication devices. In some instances, the communication antenna is put in a middle of a back cover of the mobile phone. However, users' hands cover the back cover when holding the mobile phone, which interferes with the communication antenna of the mobile phone. Therefore, how to design a communication device capable of transmitting and receiving signals with a good effect has become an important research direction.

SUMMARY OF THE INVENTION

A first object of the present invention is to provide an antenna module for being fixed to a back cover having a backboard and a top board. The antenna module includes a base portion of board shape for being fixed on a portion of an inside surface of the backboard adjacent to the top board, a first bending portion connected with a top edge of the base portion for being fixed on an inside surface of the top board, a second bending portion connected with a distal end of the first bending portion for being fixed on a front end surface of the top board, and a third bending portion connected with a distal end of the second bending portion for being fixed on an outside surface of the top board and a portion of an outside surface of the backboard adjacent to the top board.

A second object of the present invention is to provide a signal enhancement device suitable for a main body with a communication antenna. The signal enhancement device includes a back cover and an antenna module. The back cover includes a backboard for covering a rear surface of the main body and a top board connected with a top end of the backboard for covering a top of the main body. The antenna module is set in a top of the back cover and includes a base portion of board shape, a first bending portion connected with a top edge of the base portion, a second bending portion connected with a distal end of the first bending portion and a third bending portion connected with a distal end of the second bending portion. The base portion is fixed in a portion of an inside surface of the backboard adjacent to the top board, the first bending portion is fixed in an inside surface of the top board, the second bending portion is fixed in a front end face of the top board, the third bending portion is fixed in an outside surface of the top board and a portion of an outside surface of the backboard adjacent to the top board.

A third object of the present invention is to provide a communication antenna which includes a main body and a signal enhancement device. The main body has a communication antenna therein for executing communication functions. The signal enhancement device is mounted on the main body and includes a back cover and an antenna module. The back cover includes a backboard for covering a rear surface of the main body and a top board connected with a top end of the backboard for covering a top of the main body. The antenna module is set in a top of the back cover and faces to and is spaced from the communication antenna for coupling with the communication antenna. The antenna module includes a base portion of board shape, a first bending portion connected with a top edge of the base portion, a second bending portion connected with a distal end of the first bending portion and a third bending portion connected with a distal end of the second bending portion. The base portion is fixed in a portion of an inside surface of the backboard adjacent to the top board, the first bending portion is fixed in an inside surface of the top board, the second bending portion is fixed in a front end face of the top board, the third bending portion is fixed in an outside surface of the top board and a portion of an outside surface of the backboard adjacent to the top board.

As described above, when the signal enhancement device is mounted on the main body, the antenna module faces to and is spaced from the communication antenna for coupling with the communication antenna. The antenna module is used to send and receive signals of a frequency range covering 2.4 GHz that is suitable for Bluetooth and WiFi (Wireless Fidelity). The antenna module couples with the communication antenna of the main body so as to enhance signal quality of the communication antenna.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
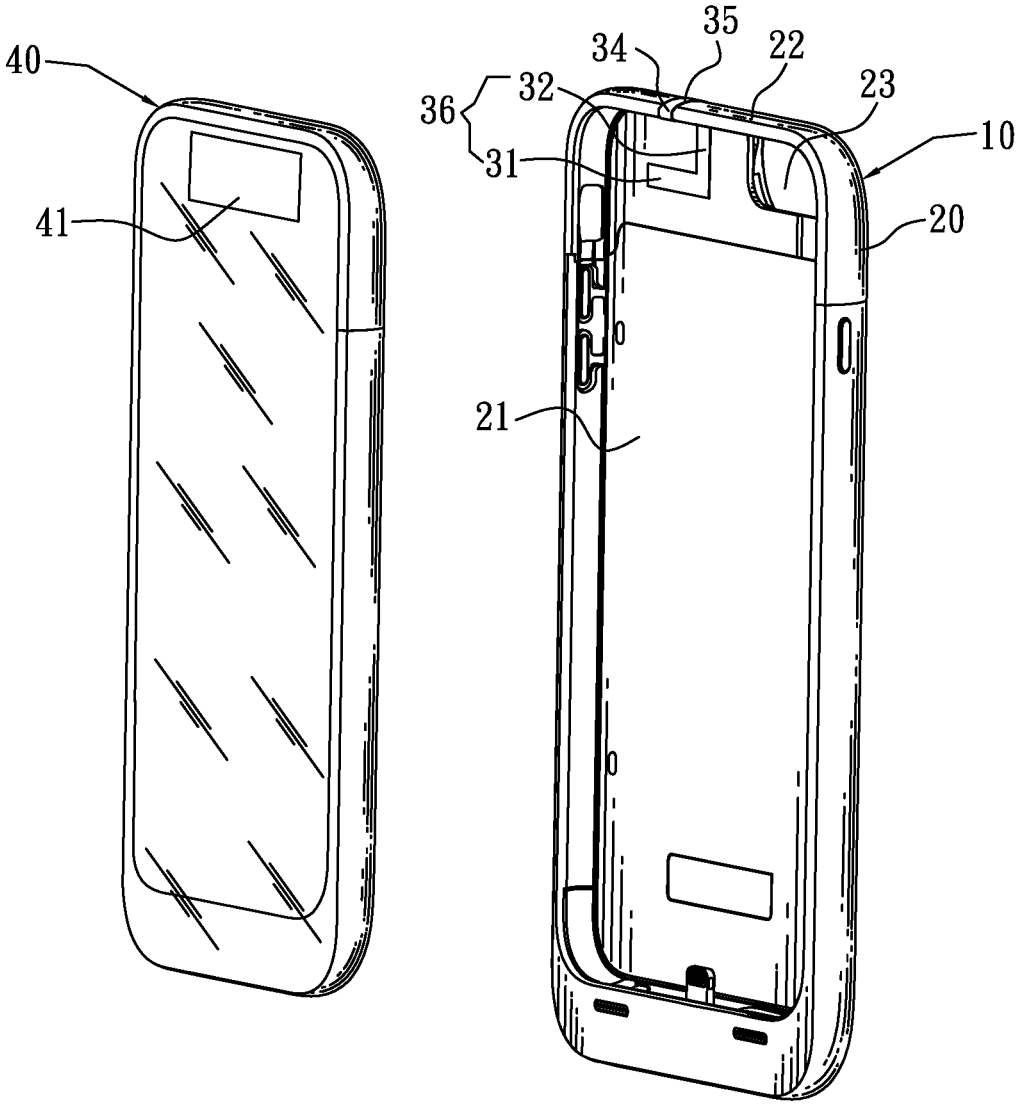
FIG. 1 is an explosive view of a communication device in accordance with some embodiments of the present invention.
Figure 2:
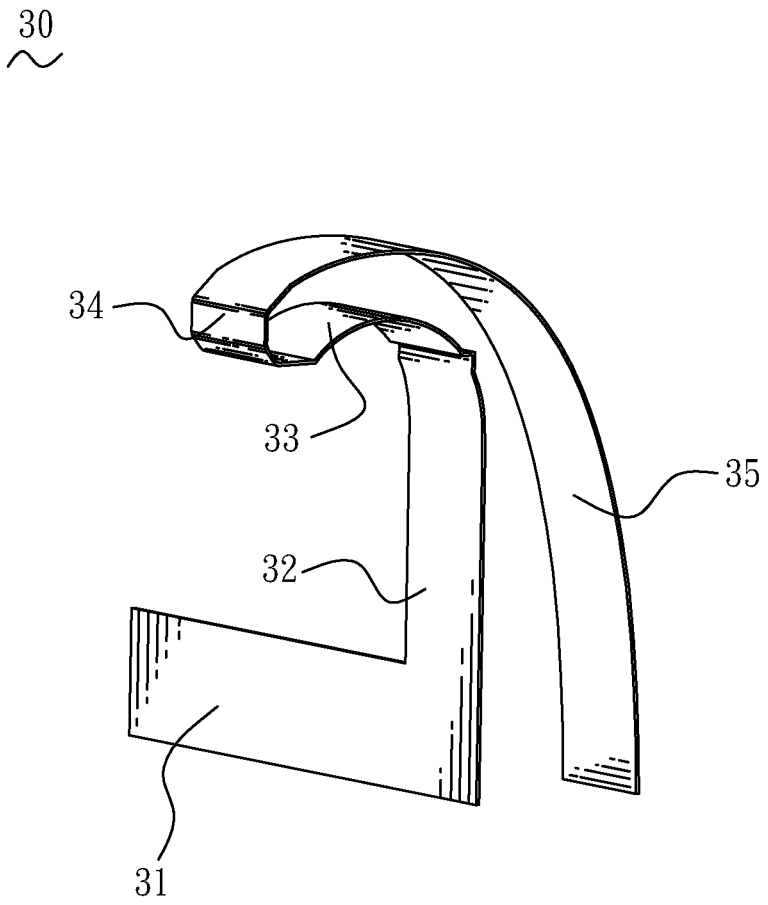
FIG. 2 is a perspective view of an antenna module of a signal enhancement device of the communication device in FIG. 1.

Referring to FIG. 1 and FIG. 2, a signal enhancement device 10 according to some embodiments of the present invention includes a back cover 20 and an antenna module 30. The signal enhancement device 10 is used as a part of a communication device. The communication device further includes a main body 40 with a communication antenna 41 therein. In some embodiments, the main body 40 is a mobile phone. The main body 40 executes predetermined communication functions by the communication antenna 41. The antenna module 30 sends and receives signals of at least one wireless frequency band and couples with the communication antenna 41 so as to enhance signal quality of the communication antenna 41. The back over 20 includes a backboard 21 for covering a rear surface of the main body 40 and a top board 22 that connects with a top end of the backboard 21 for covering a top of the main body 40. There is a camera hole 23 defined in a top portion of the backboard 21.

The antenna module 30 is made of metal conductor material. The antenna module 30 is used to send and receive signals at a frequency range covering 2.4 GHz that is suitable for Bluetooth and WiFi (Wireless Fidelity). The antenna module 30 includes a base portion 36 of board shape. The base portion 36 includes a horizontal board 31 with a roughly rectangular shape and a vertical board 32 extended upward from a side of a top edge of the horizontal board 31. A top edge of the vertical board 32 extends frontward and arches upward to form a first bending portion 33. A distal end of the first bending portion 33 extends frontward, and then bends upward and then bends rearward to form a second bending portion 34. A distal end of the second bending portion 34 extends rearward and downward with an arc bending to form a third bending portion 35. A distal end of the third bending portion 35 exceeds the vertical board 32 and is located behind the horizontal board 31.

Referring to FIG. 1 and FIG. 2, the antenna module 30 is set in a top of the back cover 20. The horizontal board 31 and the vertical board 32 are fixed in a portion of an inside surface of the backboard 21 adjacent to the top board 22. The first bending portion 33 is fixed in an inside surface of the top board 22 of the back cover 20. The second bending portion 34 is fixed in a front end surface of the top board 22. The third bending portion 35 is fixed in an outside surface of the top board 22 and a portion of an outside surface of the backboard 21 adjacent to the top board 22. The bending radian of the first bending portion 33 corresponds to the bending radian of the inside surface of the top board 22. The bending radian of the third bending portion 35 corresponds to the bending radian of the outside surface of the top board 22. When the signal enhancement device 10 is mounted on the main body 40, the antenna module 30 faces to and is spaced from the communication antenna 41 for coupling with the communication antenna 41. In some embodiments, the side of the top edge of the horizontal board 31 which extends upward to form the vertical board 32 is near the camera hole 23.

As described above, when the signal enhancement device 10 is mounted on the main body 40, the antenna module 30 faces to and is spaced from the communication antenna 41 for coupling with the communication antenna 41. The antenna module 30 is used to send and receive signals of a frequency range covering 2.4 GHz that is suitable for Bluetooth and WiFi (Wireless Fidelity). The antenna module couples with the communication antenna 41 of the main body 40 so as to enhance signal quality of the communication antenna 41.

What is claimed is:

1. An antenna module for being fixed to a back cover having a backboard and a top board, comprising:

a base portion of board shape for being fixed on a portion of an inside surface of the backboard adjacent to the top board, a first bending portion connected with a top edge of the base portion for being fixed on an inside surface of the top board, a second bending portion connected with a distal end of the first bending portion for being fixed on a front end surface of the top board, a third bending portion connected with a distal end of the second bending portion for being fixed on an outside surface of the top board and a portion of an outside surface of the backboard adjacent to the top board.

2. The antenna module as claimed in claim 1, wherein the antenna module is made of metal conductor material.

3. The antenna module as claimed in claim 1, wherein the top edge of the base portion extends frontward and arches upward to form the first bending portion, the distal end of the first bending portion extends frontward and then is bent upward and then is bent rearward to form the second bending portion, the distal end of the second bending portion extends rearward and downward with an arc bending to form the third bending portion.

4. The antenna module as claimed in claim 3, wherein the base portion includes a horizontal board with a roughly rectangular shape, a side of a top edge of the horizontal board extends upward to form a vertical board, the first bending portion is connected with a top edge of the vertical board.

5. The antenna module as claimed in claim 4, wherein a distal end of the third bending portion exceeds the vertical board and is located behind the horizontal board.

6. A signal enhancement device, suitable for a main body with a communication antenna, the signal enhancement device comprising:

a back cover, the back cover including a backboard for covering a rear surface of the main body and a top board connected with a top end of the backboard for covering a top of the main body; and an antenna module set in a top of the back cover for coupling with the communication antenna, the antenna module including a base portion of board shape, a first bending portion connected with a top edge of the base portion, a second bending portion connected with a distal end of the first bending portion and a third bending portion connected with a distal end of the second bending portion;

wherein the base portion is fixed in a portion of an inside surface of the backboard adjacent to the top board, the first bending portion is fixed in an inside surface of the top board, the second bending portion is fixed in a front end face of the top board, the third bending portion is fixed in an outside surface of the top board and a portion of an outside surface of the backboard adjacent to the top board.

7. The signal enhancement device as claimed in claim 6, wherein the antenna module is made of metal conductor material.

8. The signal enhancement device as claimed in claim 6, wherein the top edge of the base portion extends frontward and arches upward to form the first bending portion, the distal end of the first bending portion extends frontward and then is bent upward and then is bent rearward to form the second bending portion, the distal end of the second bending portion extends rearward and downward with an arc bending to form the third bending portion, when the antenna module is fixed on the back cover, the bending radian of the first bending portion corresponds to the bending radian of the inside surface of the top board, the bending radian of the third bending portion corresponds to the bending radian of the outside surface of the top board.

9. The signal enhancement device as claimed in claim 8, wherein the base portion includes a horizontal board with a roughly rectangular shape and a vertical board extended upward from a side of a top edge of the horizontal board, the first bending portion is connected with a top edge of the vertical board.

10. The signal enhancement device as claimed in claim 9, wherein a distal end of the third bending portion exceeds the vertical board and is located behind the horizontal board.

11. The signal enhancement device as claimed in claim 9, wherein a portion of the backboard adjacent to the top board defines a camera hole, the side of the top edge of the horizontal board which extends upward to form the vertical board is near the camera hole.

12. A communication device, comprising:

a main body having a communication antenna therein for executing communication functions; and a signal enhancement device mounted on the main body, the signal enhancement device including a back cover and an antenna module, the back cover including a backboard for covering a rear surface of the main body and a top board connected with a top end of the backboard for covering a top of the main body, the antenna module set in a top of the back cover, the antenna module facing to and spaced from the communication antenna for coupling with the communication antenna, the antenna module including a base portion of board shape, a first bending portion connected with a top edge of the base portion, a second bending portion connected with a distal end of the first bending portion and a third bending portion connected with a distal end of the second bending portion;

wherein the base portion is fixed in a portion of an inside surface of the backboard adjacent to the top board, the first bending portion is fixed in an inside surface of the top board, the second bending portion is fixed in a front end face of the top board, the third bending portion is fixed in an outside surface of the top board and a portion of an outside surface of the backboard adjacent to the top board.

13. The communication device as claimed in claim 12, wherein the top edge of the base portion extends frontward and arches upward to form the first bending portion, the distal end of the first bending portion extends frontward and then is bent upward and then is bent rearward to form the second bending portion, the distal end of the second bending portion extends rearward and downward with an arc bending to form the third bending portion, when the antenna module is fixed on the back cover, the bending radian of the first bending portion corresponds to the bending radian of the inside surface of the top board, the bending radian of the third bending portion corresponds to the bending radian of the outside surface of the top board.

14. The communication device as claimed in claim 13, wherein the base portion includes a horizontal board with a roughly rectangular shape and a vertical board extended upward from a side of a top edge of the horizontal board, the first bending portion is connected with a top edge of the vertical board.

15. The communication device as claimed in claim 14, wherein a distal end of the third bending portion exceeds the vertical board and is located behind the horizontal board.

16. The communication device as claimed in claim 14, wherein a portion of the backboard adjacent to the top board defines a camera hole, the side of the top edge of the horizontal board which extends upward to form the vertical board is near the camera hole.

17. The communication device as claimed in claim 12, wherein the antenna module is made of metal conductor material.

* * * * *